US006962218B2

(12) United States Patent
Eyre

(10) Patent No.: US 6,962,218 B2
(45) Date of Patent: Nov. 8, 2005

(54) CUTTING ELEMENTS WITH IMPROVED CUTTING ELEMENT INTERFACE DESIGN AND BITS INCORPORATING THE SAME

(75) Inventor: Ronald K. Eyre, Orem, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/453,399

(22) Filed: Jun. 3, 2003

(65) Prior Publication Data

US 2004/0245025 A1 Dec. 9, 2004

(51) Int. Cl.[7] ..... E21B 10/46
(52) U.S. Cl. ..... 175/432
(58) Field of Search ..... 175/432, 430, 175/431, 428, 426, 420.1; D15/139; 403/332

(56) References Cited

U.S. PATENT DOCUMENTS

| | | | | |
|---|---|---|---|---|
| 4,866,885 | A | | 9/1989 | Dodsworth |
| 4,997,049 | A | | 3/1991 | Tank et al. |
| 5,007,207 | A | | 4/1991 | Phaal |
| 5,120,327 | A | | 6/1992 | Dennis |
| 5,141,289 | A | | 8/1992 | Stiffler |
| 5,217,081 | A | | 6/1993 | Waldenstrom et al. |
| 5,335,738 | A | | 8/1994 | Waldenstrom et al. |
| 5,351,772 | A | | 10/1994 | Smith |
| 5,355,969 | A | | 10/1994 | Hardy et al. |
| 5,379,854 | A | | 1/1995 | Dennis |
| 5,469,927 | A | | 11/1995 | Griffin |
| 5,484,330 | A | | 1/1996 | Flood et al. |
| 5,486,137 | A | | 1/1996 | Flood et al. |
| 5,492,188 | A | | 2/1996 | Smith et al. |
| 5,564,511 | A | | 10/1996 | Frushour |
| D377,655 | S | * | 1/1997 | Smith ..... D15/139 |
| 5,590,727 | A | | 1/1997 | Tank et al. |
| 5,590,728 | A | | 1/1997 | Matthias et al. |
| 5,605,199 | A | | 2/1997 | Newton |
| 5,611,649 | A | | 3/1997 | Matthias |
| 5,617,928 | A | | 4/1997 | Matthias et al. |
| 5,662,720 | A | | 9/1997 | O'Tighearnaigh |
| 5,669,271 | A | | 9/1997 | Griffin et al. |
| 5,706,906 | A | | 1/1998 | Jurewicz et al. |
| 5,709,279 | A | | 1/1998 | Dennis |
| 5,711,702 | A | | 1/1998 | Devlin |
| 5,788,001 | A | | 8/1998 | Matthias et al. |
| 5,816,347 | A | | 10/1998 | Dennis et al. |
| 5,829,541 | A | | 11/1998 | Flood et al. |
| 5,871,060 | A | | 2/1999 | Jensen et al. |
| 5,928,071 | A | | 7/1999 | Devlin |
| 5,957,228 | A | | 9/1999 | Yorston et al. |
| 5,971,087 | A | | 10/1999 | Chaves |
| 5,979,577 | A | | 11/1999 | Fielder |
| 6,011,232 | A | | 1/2000 | Matthias |

(Continued)

FOREIGN PATENT DOCUMENTS

| | | |
|---|---|---|
| GB | 2 364 082 A | 1/2002 |
| GB | 2 367 081 A | 3/2002 |
| GB | 2 379 695 A | 3/2003 |

OTHER PUBLICATIONS

Diamond–Edge Geometry, Diamond Bits—Genesis—Advanced Cutter Technology, 2002 Baker Hughes Incorporated, 1 page.

Search Report under Section 17(6) for U.K. Application No. GB0407674.1; Oct. 28, 2004; 3 pages.

* cited by examiner

*Primary Examiner*—Kenneth Thompson
(74) *Attorney, Agent, or Firm*—Christie, Parker & Hale, LLP

(57) ABSTRACT

Cutting elements having a non-planar substrate interface surface including a band and an ultra hard material layer over the interface surface are provided. Also provided are earth boring bits incorporating such cutting elements.

79 Claims, 13 Drawing Sheets

U.S. PATENT DOCUMENTS 6,026,919 A 2/2000 Thigpen et al.
6,029,760 A 2/2000 Hall
6,041,875 A 3/2000 Rai et al.
6,065,554 A 5/2000 Taylor et al.
6,077,591 A 6/2000 Griffin
6,082,223 A 7/2000 Tibbitts
6,082,474 A 7/2000 Matthias
6,145,607 A 11/2000 Griffin et al.
6,148,937 A 11/2000 Mensa-Wilmot et al.
6,149,695 A 11/2000 Adia et al.
6,187,068 B1 2/2001 Frushour et al.
6,189,634 B1 2/2001 Bertagnolli et al.
6,196,341 B1 3/2001 Chaves
6,196,910 B1 3/2001 Johnson et al.
6,202,771 B1 3/2001 Scott et al.
6,227,319 B1 5/2001 Radford
6,315,067 B1 11/2001 Fielder
6,315,652 B1 11/2001 Snyder et al.
6,488,106 B1 * 12/2002 Dourfaye ..... 175/428
6,571,891 B1 * 6/2003 Smith et al. ..... 175/428
6,739,417 B2 5/2004 Smith et al.

STRESS RELATIONSHIPS TO GEOMETRY

CUTTING ELEMENTS WITH IMPROVED CUTTING ELEMENT INTERFACE DESIGN AND BITS INCORPORATING THE SAME

FIELD OF THE INVENTION

This invention relates to cutting elements used in earth boring bits for drilling earth formations. Specifically this invention relates to cutting elements having a non-planar interface region having a reduced residual stress build up and to earth boring bits incorporating the same.

BACKGROUND OF THE INVENTION

A cutting element typically has cylindrical cemented carbide substrate body having an end face (also referred to herein as an "interface surface"). An ultra hard material layer, such as polycrystalline diamond or polycrystalline cubic boron nitride, is bonded on the interface surface forming a cutting layer. The cutting layer can have a flat or a curved interface surface.

Generally speaking the process for making a cutting element employs a body or substrate of cemented tungsten carbide where the tungsten carbide particles are cemented together with cobalt. The carbide body is placed adjacent to a layer of ultra hard material particles such as diamond of cubic boron nitride (CBN) particles and the combination is subjected to a high temperature at a high pressure where diamond or CBN is thermodynamically stable. This results in recrystallization and formation of a polycrystalline diamond or polycrystalline cubic boron nitride layer on the surface of the cemented tungsten carbide. This ultra hard material layer may include tungsten carbide particles and/or small amounts of cobalt. Cobalt promotes the formation of polycrystalline diamond or polycrystalline cubic boron nitride and if not present in the layer of diamond or CBN, cobalt will infiltrate from the cemented tungsten carbide substrate.

The cemented tungsten carbide substrate is typically formed by placing tungsten carbide powder and a binder in a mold and then heating to the binder melting temperature causing the binder to melt and infiltrate the tungsten carbide particles fusing them together and cementing the substrate. Alternatively, the tungsten carbide powder may be cemented by the binder during the high temperature, high pressure process used to re-crystalize the ultra hard material layer. In such case, the substrate material powder along with a binder are placed in a can typically formed from a refractory metal, forming an assembly. Ultra hard material particles are provided over the substrate material to form the ultra hard material polycrystalline layer. The entire assembly can is then subjected to a high temperature, high pressure process forming a cutting element having a substrate and a polycrystalline ultra hard material layer over it.

The problem with many cutting elements is the development of cracking, spalling, chipping and partial fracturing of the ultra hard material cutting layer at the layer's region subjected to the highest impact loads during drilling, especially during aggressive drilling. To overcome these problems, cutting elements have been formed having a non-planar substrate interface surface having grooves or depressions. Applicant has discovered that these grooves or depressions cause the build-up of high residual stresses on the interface surface leading to premature interfacial delamination of the ultra hard material layer from the substrate. Delamination failures become more prominent as the thickness of the ultra hard material layer increases. However, it is believed that the impact strength of the ultra hard material layer increases with an increase in the ultra hard material layer thickness.

Another problem with an increase in the thickness of the ultra hard material layer, is that the edges of the ultra hard material furthest from the substrate are starved of cobalt from the substrate during the sintering process resulting in the ultra hard material edges having decreased strength. Consequently, the edges become brittle and have lower impact strength and wear resistance. In an effort to solve this problem, some cutting elements incorporate a frustum-conical section defined on the substrate interface surface that is surrounded by the ultra hard material layer. In this regard, the edges of the ultra hard material layer are closer to the cobalt source, i.e., the frustum conical section of the substrate. However these cutting elements are also subject to the build-up of high residual stresses on the interface region leading to premature interfacial delamination of the ultra hard material layer.

Consequently, a cutting element is desired that can be used for aggressive drilling and which is not subject to early or premature failure, as for example by delamination of the ultra hard material layer from the substrate, and which has sufficient impact strength resulting in an increased operating life.

SUMMARY OF THE INVENTION

This invention relates to cutting elements used in earth boring bits for drilling earth formations. Specifically this invention relates to cutting elements having a non-planar interface region having reduced residual stress build-up and to earth boring bits incorporating the same.

In one exemplary embodiment, a cutting element is provided having a substrate having an end surface (or "interface surface"). The end surface has a periphery and a projecting band spaced from the periphery. The band has a continuous surface defining an inner surface portion closer to a center of the end surface, an outer surface portion closer to the periphery and a bridging surface portion bridging the inner and outer surface portions. The end surface also has a plurality of ribs extending from the band inward away from the periphery. An ultra hard material layer is formed over the end surface. In another exemplary embodiment, the end surface further includes a protrusion that is spaced from the band and surrounded by the band. In exemplary embodiments, the ribs may or may not extend to the protrusion.

In another exemplary embodiment, the ribs extend radially inward defining a depression having a generally trapezoidal shape in plan view between the band, the protrusion and two consecutive ribs. In other exemplary embodiments, depressions are formed on the band. These depressions may be radially inwardly extending depressions, radially outwardly extending depressions and/or generally downwardly extending depressions.

In yet another exemplary embodiment, a cutting element is provided having an end surface. The end surface has a periphery and a projecting band having a continuous surface defining an inner surface portion closer to a center of the end surface, an outer surface portion closer to the periphery and a bridging surface portion between the inner and outer surface portions. A plurality of band depressions are formed on the band bridging surface portion, and a plurality of inwardly extending radial depressions are formed on the outer surface portion of the band. An ultra hard material layer over the end surface.

In yet a further exemplary embodiment, the end surface has a diameter and the band has a radial thickness such that a maximum radial thickness of the band is in the range of about 2% of the diameter to about 40% of the diameter of the end surface. In another exemplary embodiment, the ultra hard material layer has a thickness as measured at a periphery of the ultra hard material layer that is not less than about 0.04 inch. In a further exemplary embodiment, the ultra hard material has a thickness as measured at a periphery of the ultra hard material layer that is greater than about 0.25 inch. In another exemplary embodiment, the radial distance from the periphery of the end surface to the apex of the band is in the range of about 15% of the thickness of the ultra hard material layer at the ultra hard material periphery to about 35% of the diameter substrate end surface periphery. In yet another exemplary embodiment, the band has a height as measured from the periphery of the end surface that is in the range of about 25% to about 85% of the thickness of the ultra hard material layer. In a further exemplary embodiment, the radial distance from the periphery of the end surface to the apex of the band is in the range of about 15% of the thickness of the ultra hard material layer to about 35% of the diameter of the end surface.

In other exemplary embodiments, the ultra hard material layer has a thickness at its periphery that is greater than about 0.25 inch. In a further exemplary embodiment, the ultra hard material layer thickness at is periphery is not less than about 0.04 inch. In another exemplary embodiment, at least one transition layer may be provided between the end surface and the ultra hard material layer. In other exemplary embodiments, a bit body incorporating any of the exemplary embodiment cutting elements is provided.

DETAILED DESCRIPTION

Figure 1A:
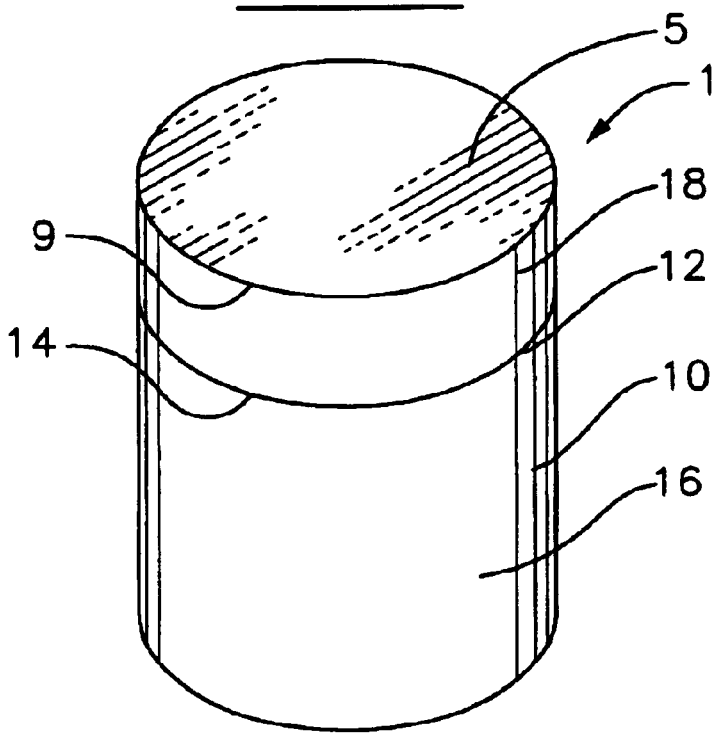
FIG. 1A PRIOR ART
FIG. 1A is a perspective view of a conventional cutting element.

A cutting element 1 has a body (i.e., a substrate) 10 having an interface surface 12 (FIG. 1A). The body is typically cylindrical having an end face forming the interface surface 12 and a cylindrical outer surface 16. A circumferential edge 14 is formed at the intersection of the interface surface 12 and the cylindrical outer surface 16 of the body. An ultra hard material layer 18 such a polycrystalline diamond or cubic boron nitride layer is formed over the interface surface of the substrate. Some cutting elements have an interface surface on which is defined a frustum-conical section 17 as shown in FIG. 1B.

Figure 3:
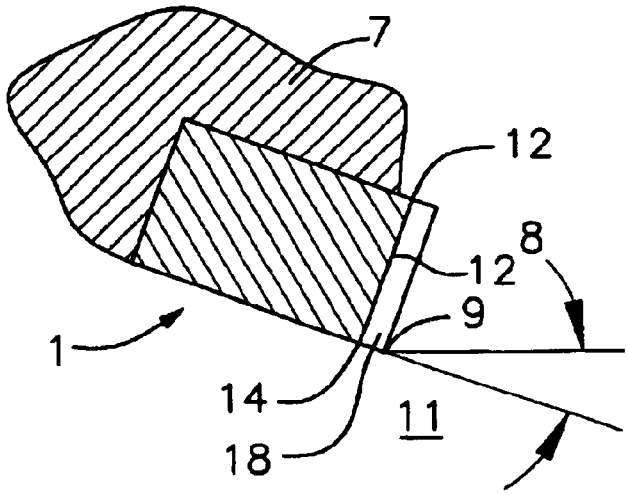
FIG. 3 is a partial cross-sectional view of a cutting element mounted on the bit body shown in FIG. 2.
Figure 2:
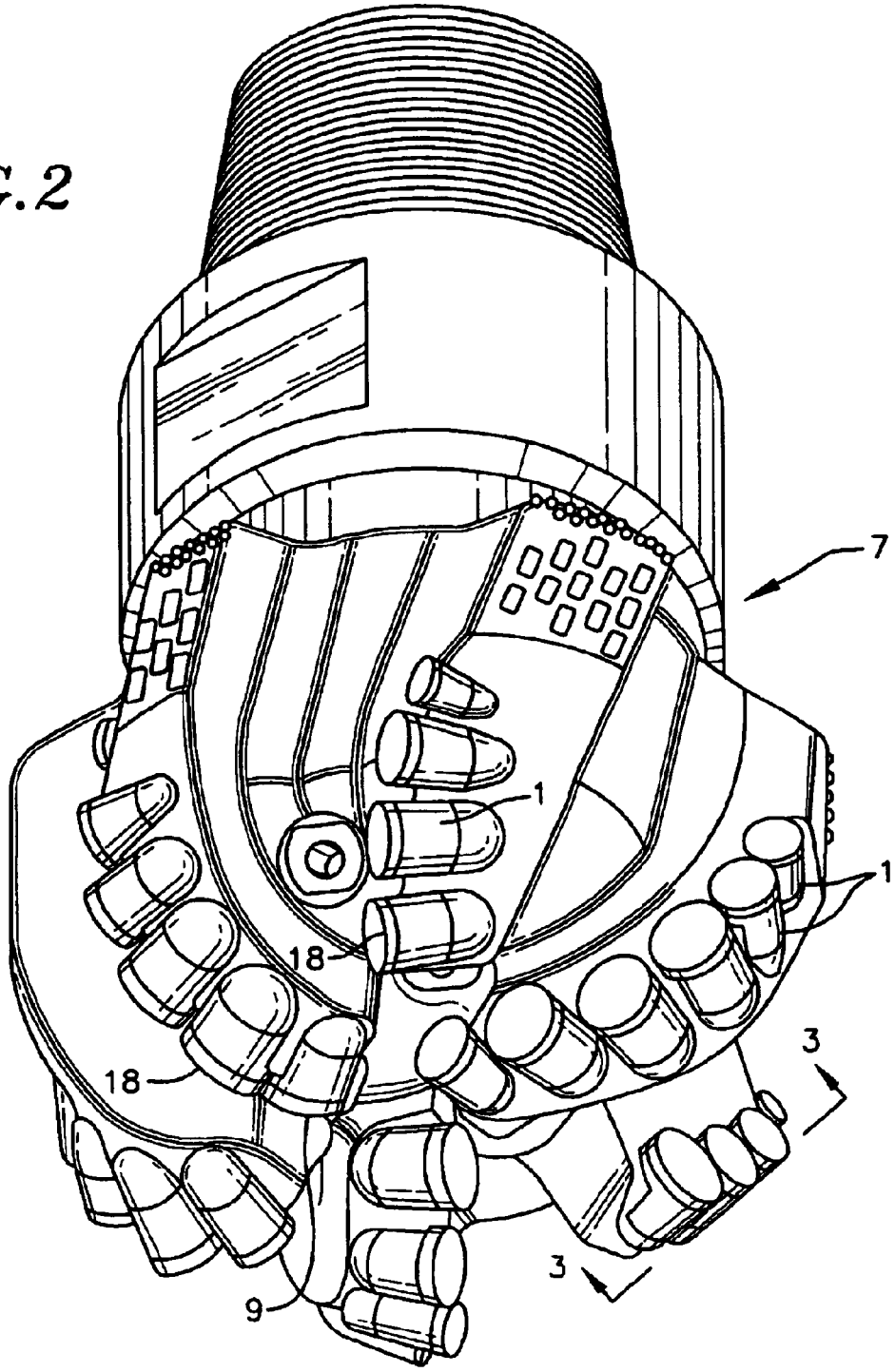
FIG. 2 is a perspective view of a drag bit body having cutting elements mounted thereon.
Figure 4:
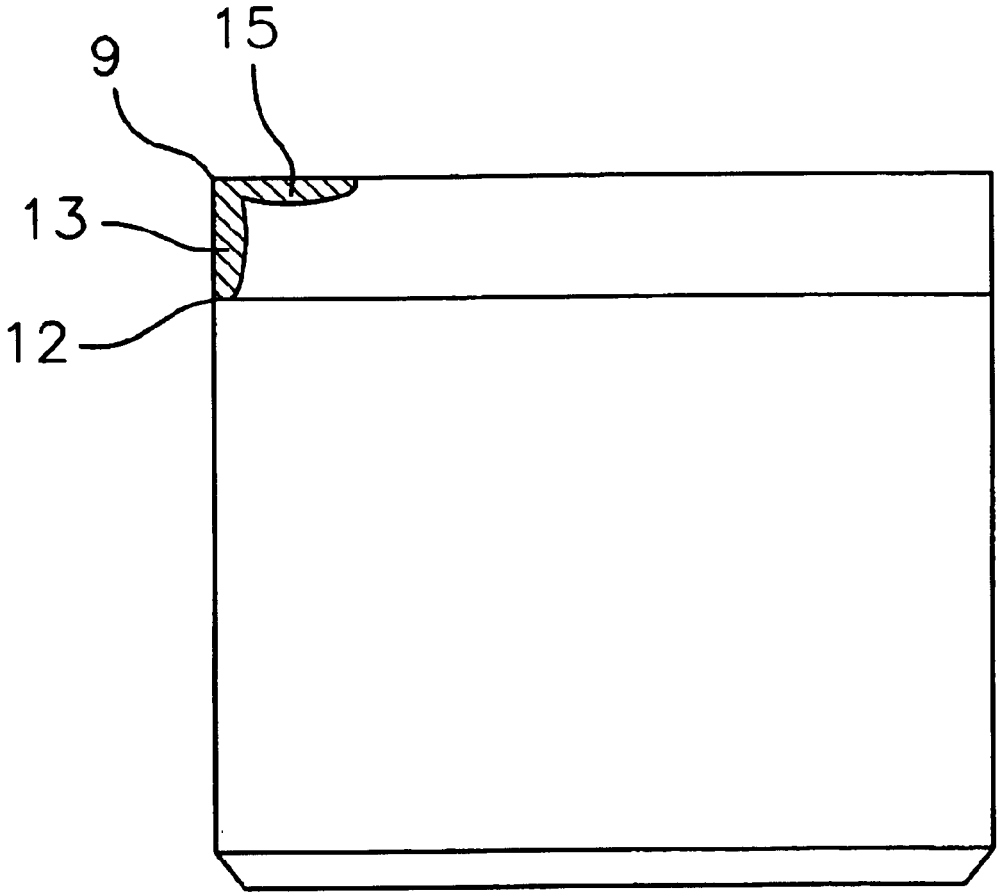
FIG. 4 is an end view of a cutting element depicting the critical stress regions on the edge and the upper surface of the cutting element ultra hard material layer.

The cutting elements are mounted on an earth boring bit such as a drag bit 7 (as best shown in FIG. 2) at a rake angle 8 (as shown in FIG. 3) and contact the earth formation 11 during drilling along an edge 9 (referred to herein for convenience as the "critical edge") of their cutting layer 18. Consequently, the critical stress areas on the ultra hard material layer of each cutting element are the areas adjacent to and including the critical edge. These areas are defined by the edge critical region 13 as shown in FIG. 4 which is a circumferential portion of the ultra hard material layer extending from the critical edge 9 to the substrate interface surface 12, and by the cutting layer upper surface critical stress region 15 which is a region of the ultra hard material layer extending from the critical edge radially inward, as for example shown in FIG. 4. Applicant has discovered that the stress distribution in the critical stress areas can be controlled by incorporating a band on the interface surface of the substrate having a continuously curving outer surface in cross-section, as for example band 28 shown in FIG. 5. The band outer surface may have multiple radii.

Figure 6A:
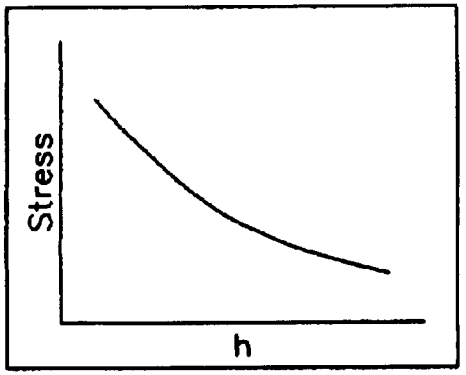
FIGS. 6A–6E are graphs of the relationship of the stress at the edge critical region of an exemplary embodiment cutting element as a function of height, radial distance to the apex of the band, band width, the ratio of the thickness of the ultra hard material layer to the height of the band, and the depth of a central cavity defined by the band, respectively.
Figure 6B:
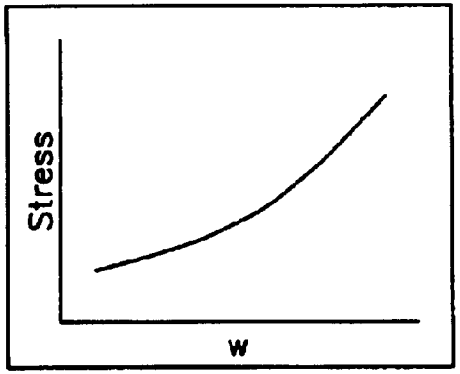
Figure 6C:
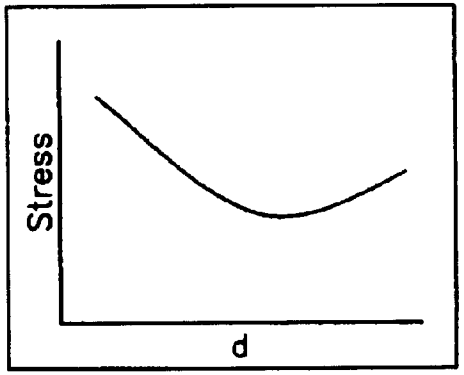
Figure 6D:
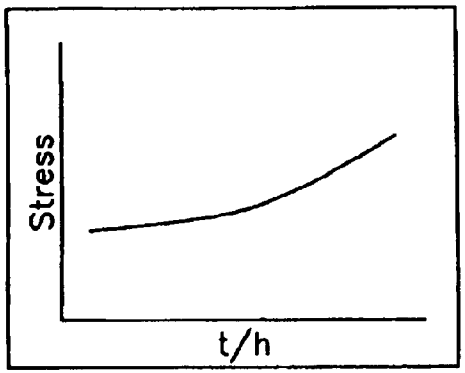
Figure 6E:
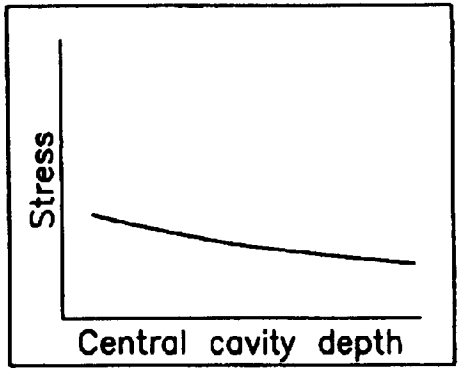
Figure 6F:
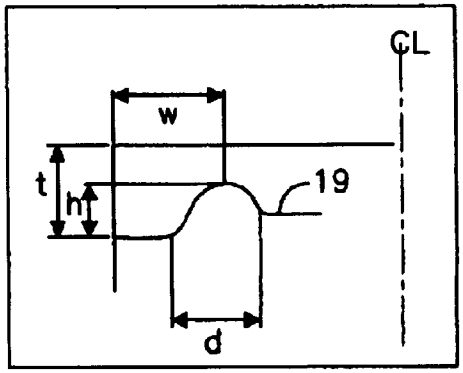
FIG. 6F is a legend of the parameters against which the graphs in FIG. 6A-6E are plotted.

Applicant through analysis has discovered the effects of the band on the edge critical stress region. The general results of this analysis are plotted in FIGS. 6A–6E where the stress on the edge critical region is plotted against: (1) h, the height of the band as measured from the location of the interface surface at the periphery of the substrate (FIG. 6A); (2) w, the radial distance to the apex of the band from the periphery of the cutting element (FIG. 6B); (3) d, the cross-sectional width of the band (FIG. 6C); t/h, the ratio of the thickness of the ultra hard material layer as measured at the periphery of substrate to the height of the band (FIG. 6D); and (4) the depth of the central cavity that is defined by the band as measured from the apex of the band (FIG. 6E). From this analysis, applicant has discovered that the stress levels at the edge critical region 13 are minimized when using an ultra hard material layer having a thickness, t, of 0.040 inch and higher including ultra hard material layer thickness, t, greater than ¼ inch when the band height is in a range from about 20% to about 85% of the thickness, t, of the ultra hard material layer, the radial distance w is from about 15% of the thickness, t, of the ultra hard material layer to about 35% of the cutting element diameter and the cross-sectional width, d, of the band is in the range of about 2% to about 40% of the cutting element diameter. Moreover, for a given ultra hard material layer thickness, t, as w (the radial distance from the periphery to the apex of the band) and h (the height of band) increases, the residual stresses on the edge critical region and the cutting layer upper surface critical stress region decrease.

Figure 1B:
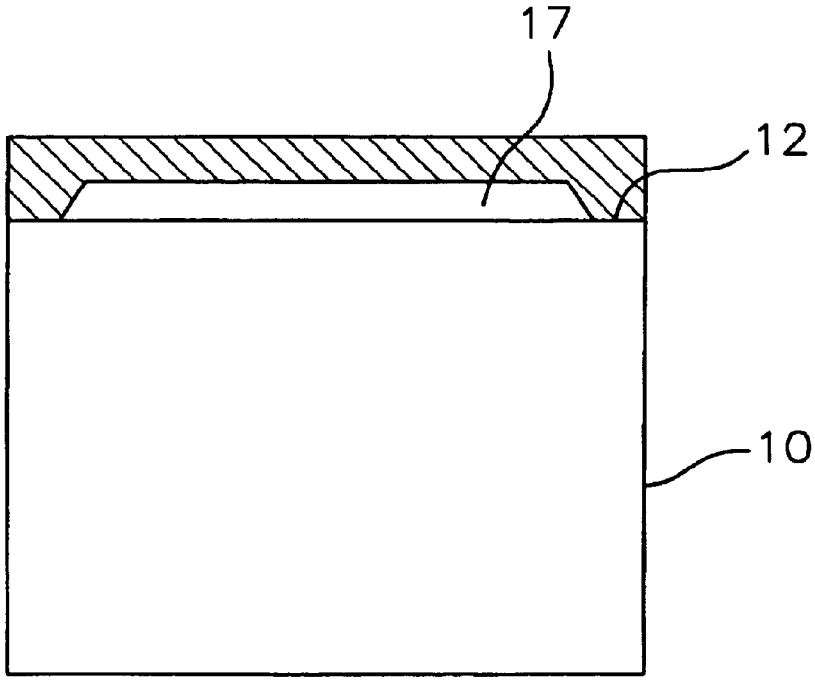
FIG. 1B PRIOR ART
FIG. 1B is a cross-sectional view of another conventional cutting element having a frustum-conical section surface formed on its interface surface.
Figure 7:
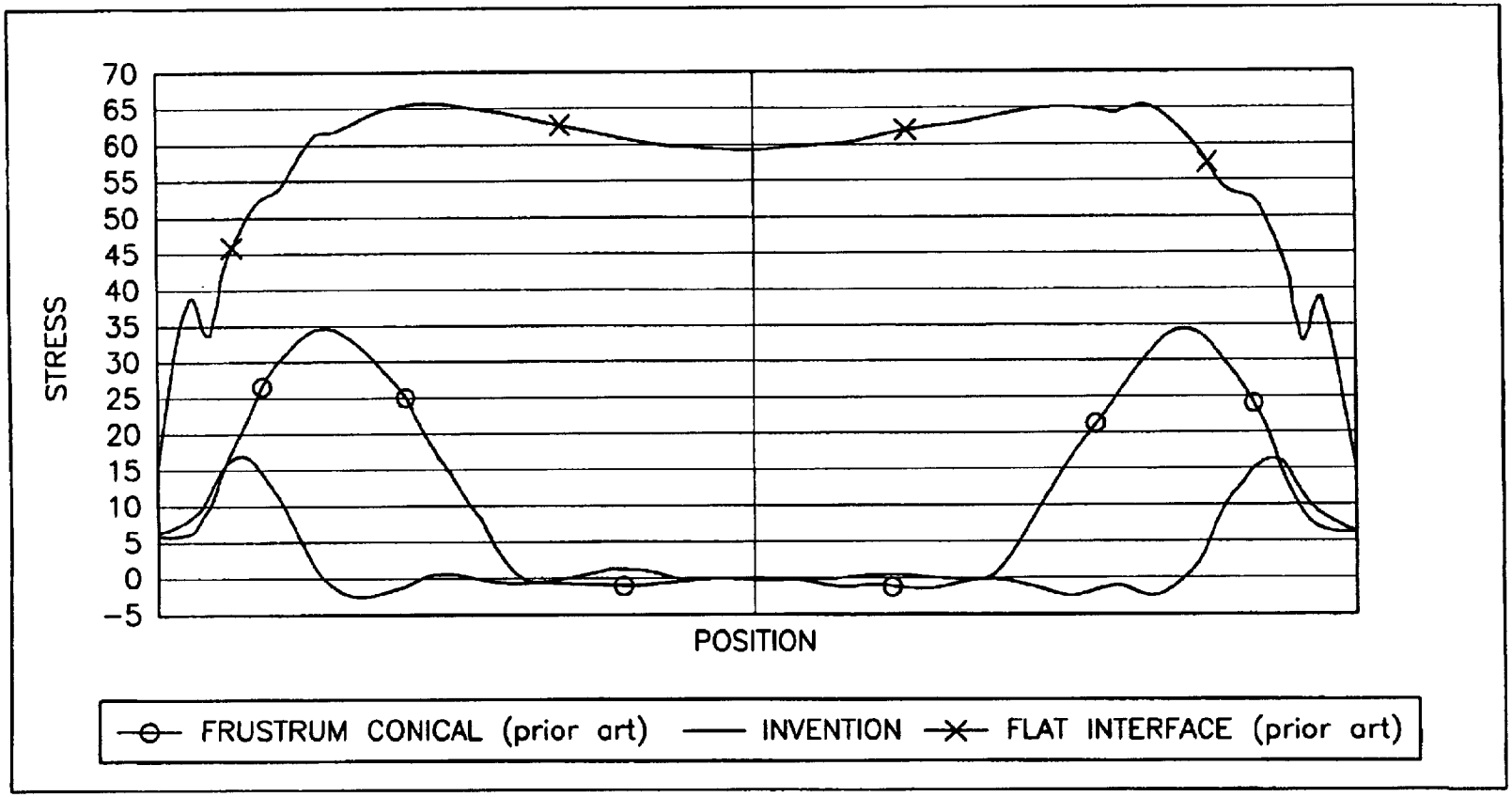
FIG. 7 is a graph depicting the cutting layer upper surface critical stress region distribution for an exemplary cutting element substrate of the present invention and for conventional cutting element substrates.

A cutting layer upper surface critical stress region 15 stress distribution comparison for an exemplary embodiment element incorporating a continuously curving band on its substrate interface surface and of the prior art cutting elements having a flat interface surface and a interface surface having a frustum-conical section shown in FIGS. 1A and 1B, respectively is shown in FIG. 7. As can be seen by the graph of FIG. 7, the cutting layer upper surface critical stress region stress distribution is lowered for the exemplary embodiment cutting element than for the prior art cutting elements shown in FIGS. 1A and 1B.

Figure 8:
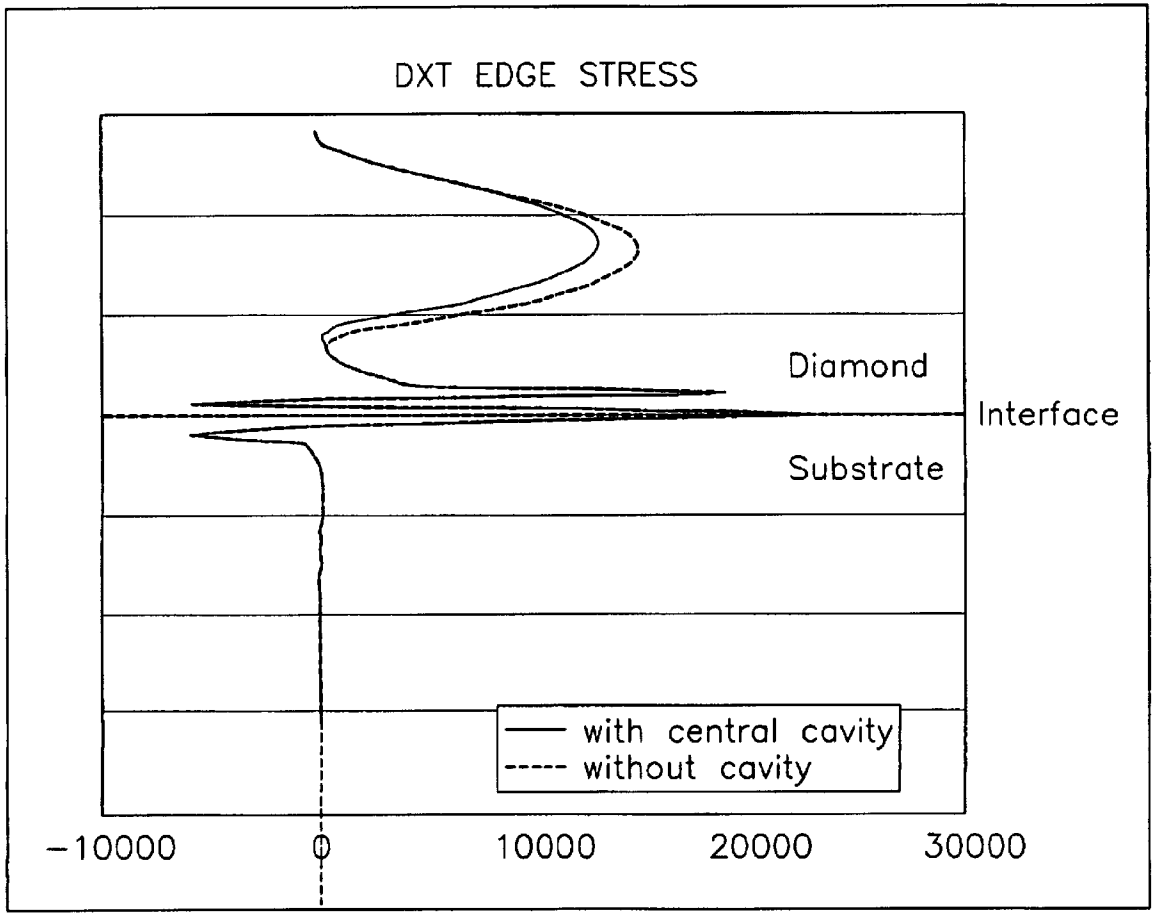
FIG. 8 is a graph of edge stress distribution between an exemplary embodiment cutting element of the present invention with and without a central cavity.
Figure 9:
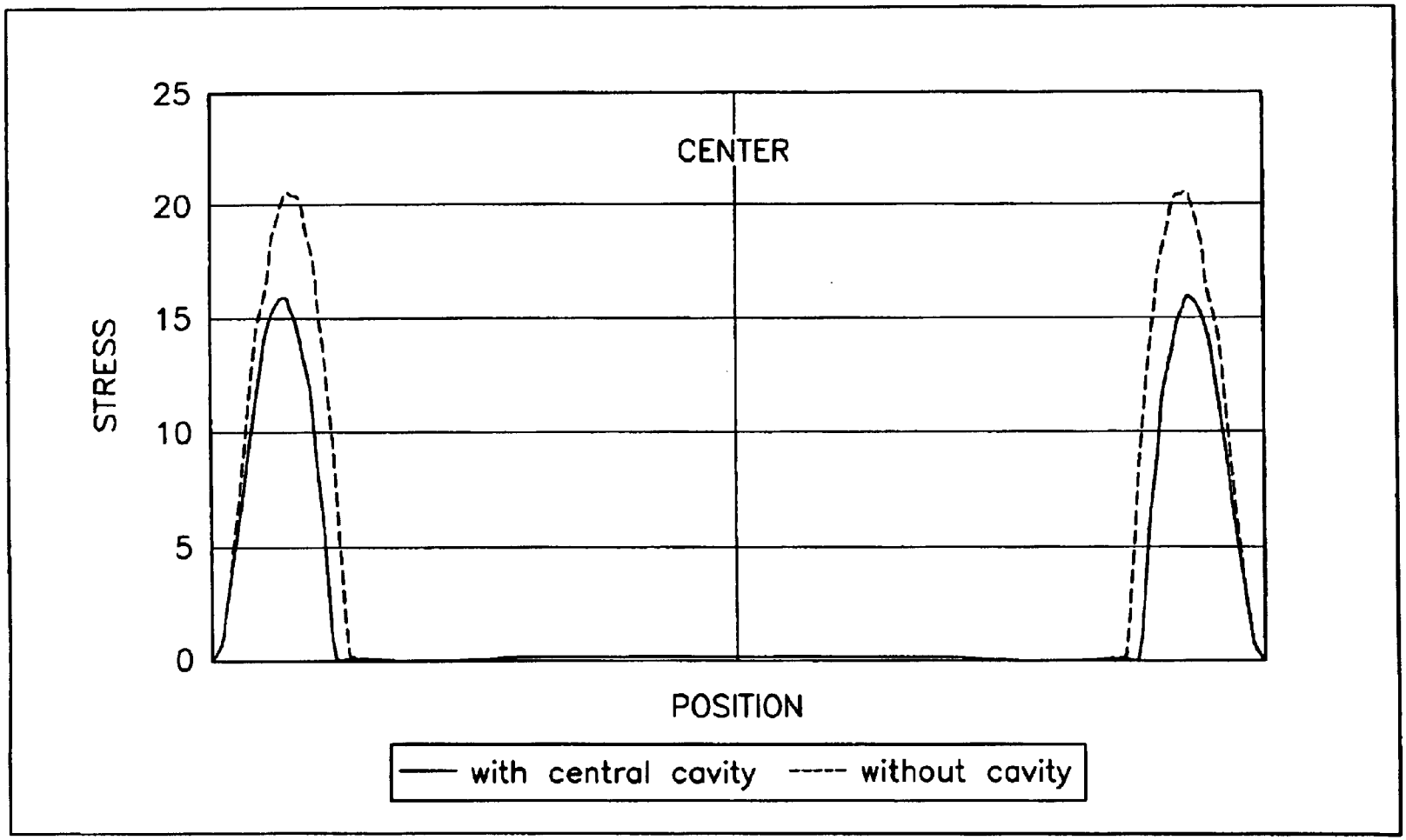
FIG. 9 is a graph of cutting layer upper surface stress distribution between an exemplary embodiment cutting element of the present invention with or without a central cavity.

Applicant has also discovered that the central cavity 19 (FIGS. 5 and 6E) defined by the band also serves to reduce the level of stresses at the edge critical region 13 as shown in FIG. 6E and also FIG. 8 and on the cutting layer upper surface critical stress region 15 as shown in FIG. 9.

Applicant has discovered that stress distribution on the edge critical region and on the cutting layer upper surface critical stress region of a cutting element was significantly less than on cutting elements of the same dimensions having a flat interface surface or a interface surface having a fraustum-conical section such as the cutting elements as shown in FIGS. 1A and 1B, respectively.

Figure 10:
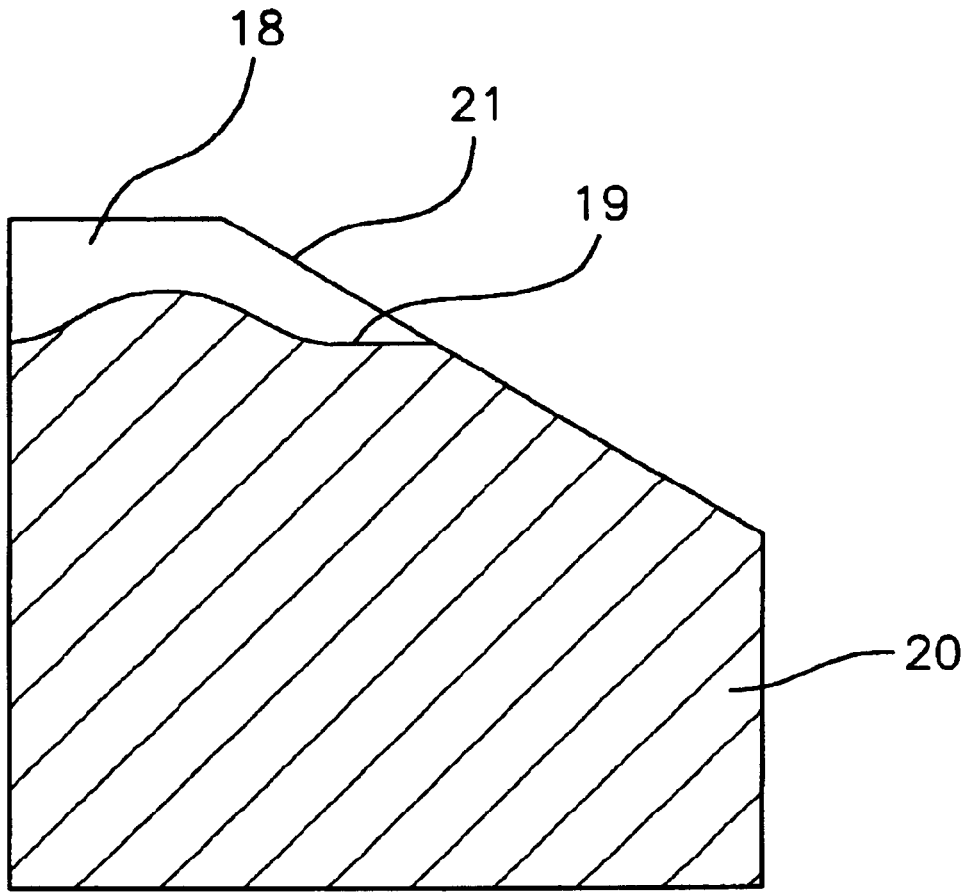
FIG. 10 is a cross-sectional view of an exemplary embodiment cutting element of the present invention worn due to cutting.

The central cavity 19 provides the additional benefit of added ultra hard material. Even when the cutting layer is worn to more than 50% as for example shown in FIG. 10A, a substantial portion 21 of the ultra hard material layer 18 will still be available for cutting. Applicant also believes that some extra benefits may be obtained by providing a protrusion of substrate material extending from the central cavity as for example protrusion 40 shown in FIGS. 11 and 12. The protrusion provides for a cobalt source closer to the outer surface of the ultra hard material layer during sintering, preventing cobalt starvation of the outer surface of the ultra hard material layer, and resulting in increased strength and ductility of the ultra hard material outer surface.

Figure 5:
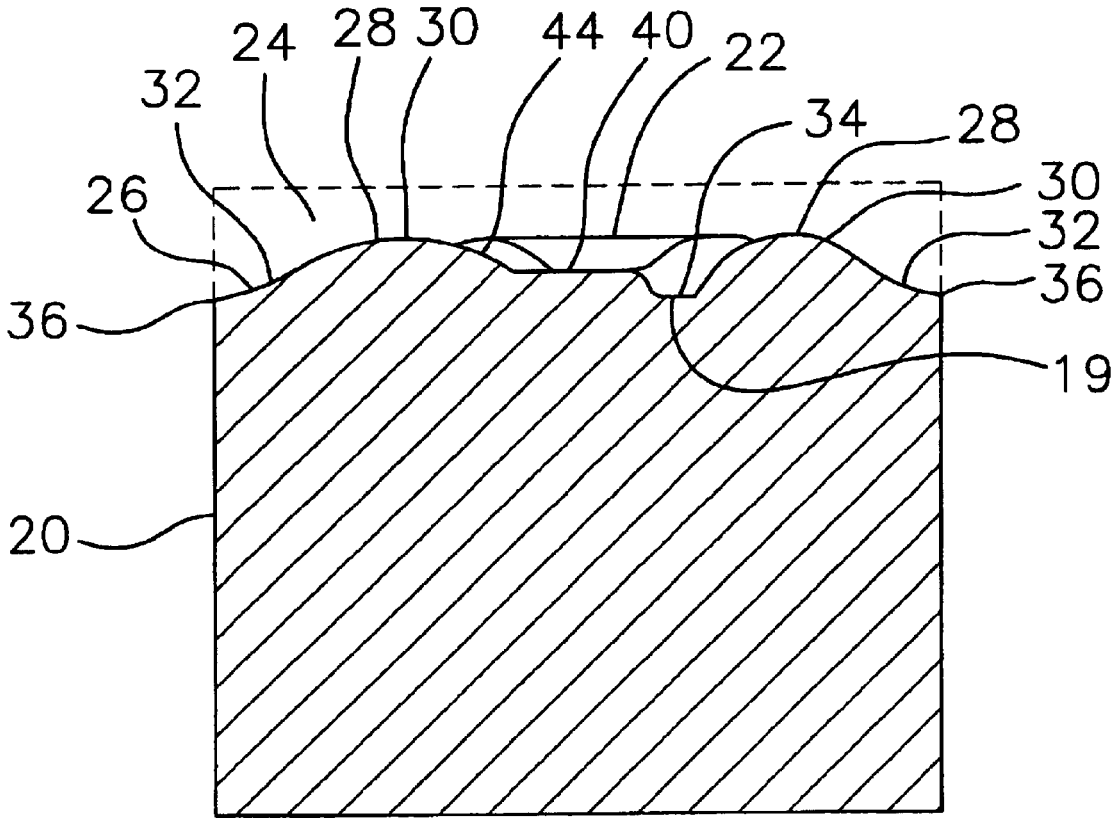
FIG. 5 is a cross-sectional view of an exemplary cutting element of the present invention.
Figure 11:
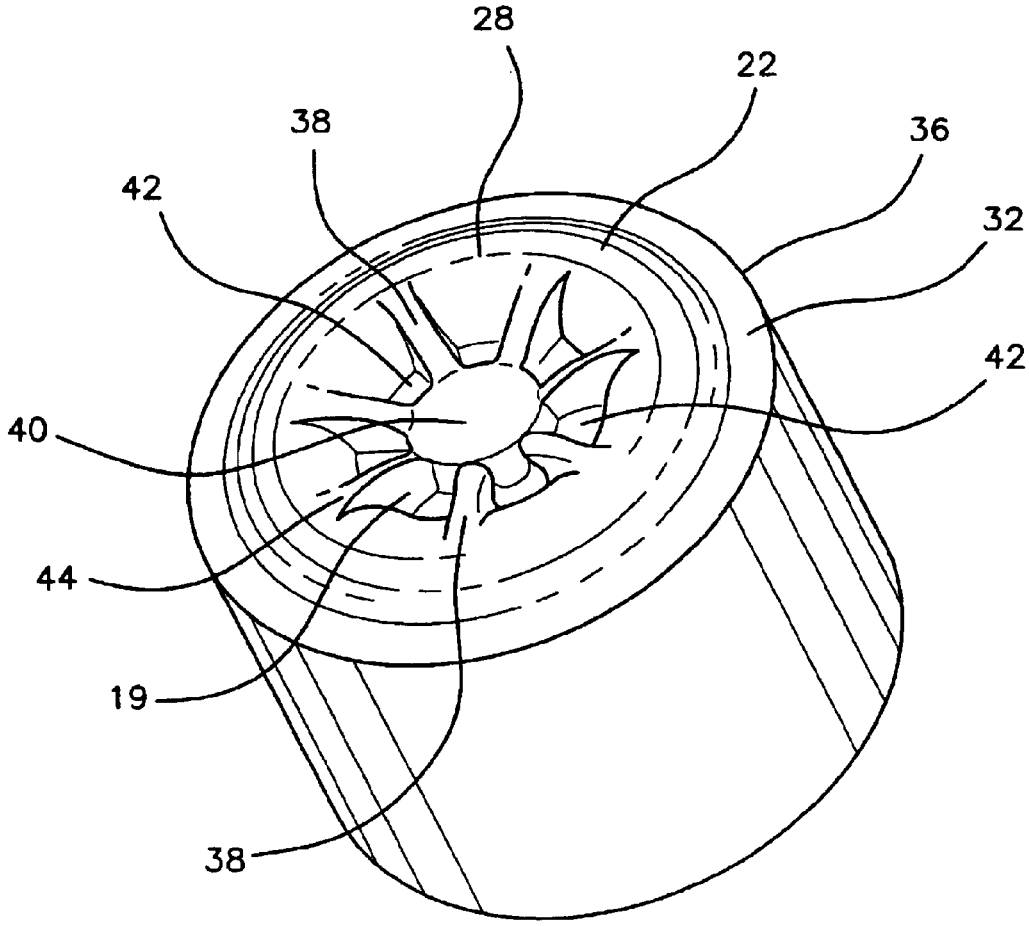
FIG. 11 is a perspective top view of an exemplary embodiment cutting element substrate of the present invention.

An exemplary embodiment cutting element of the present invention as shown in FIGS. 5 and 11 (with and without the ultra hard material layer, respectively) has a substance body of 20 having an interface surface 22 over which is formed an ultra hard material layer 24. The ultra hard material layer has a surface 26 interfacing with the interface surface 22 that is complementary to the interface surface 22. In the exemplary embodiment shown in FIGS. 5 and 10, the interface surface comprises a band 28 having a continuous curving surface 30 which curves in the same direction in cross-section. Surfaces 32 and 34 extending from surface 30 curve in an opposite direction. The band 28 is formed interior of the circumferential edge 36 of the cutting element and in the shown exemplary embodiment is centered. Ribs 32 extend radially inward from the band 28. In the exemplary embodiment shown in FIGS. 5 and 11, ribs 38 extend to a generally circular protrusion 40 extending from a center portion of the interface surface 22. Consequently, depressions 42 having a generally trapezoid shape in plan view, are formed between adjacent ribs 38, the band 28 and the central protrusion 40.

In the exemplary embodiment shown in FIG. 5, the ribs have a generally flattened upper surface 44 interfacing with the band 28. Moreover, in the exemplary embodiment the ribs 38 upper surfaces interface with an upper surface of the protrusion 40.

Figure 12:
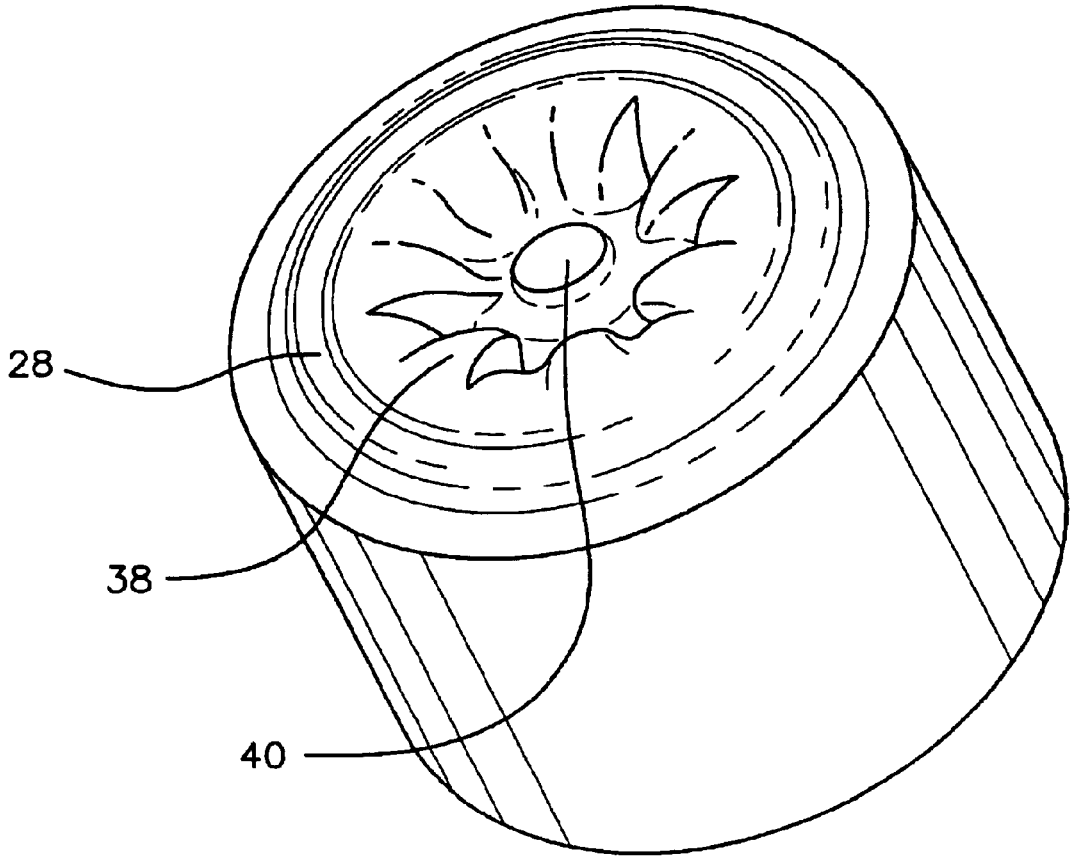
FIG. 12 is a perspective top view of another exemplary embodiment cutting element substrate of the present invention.

In an alternate embodiment shown in FIG. 12, the ribs 38 extend from the band to a location short of the protrusion 40. Either of the aforementioned embodiments may be formed without the central protrusion 40.

Figure 13:
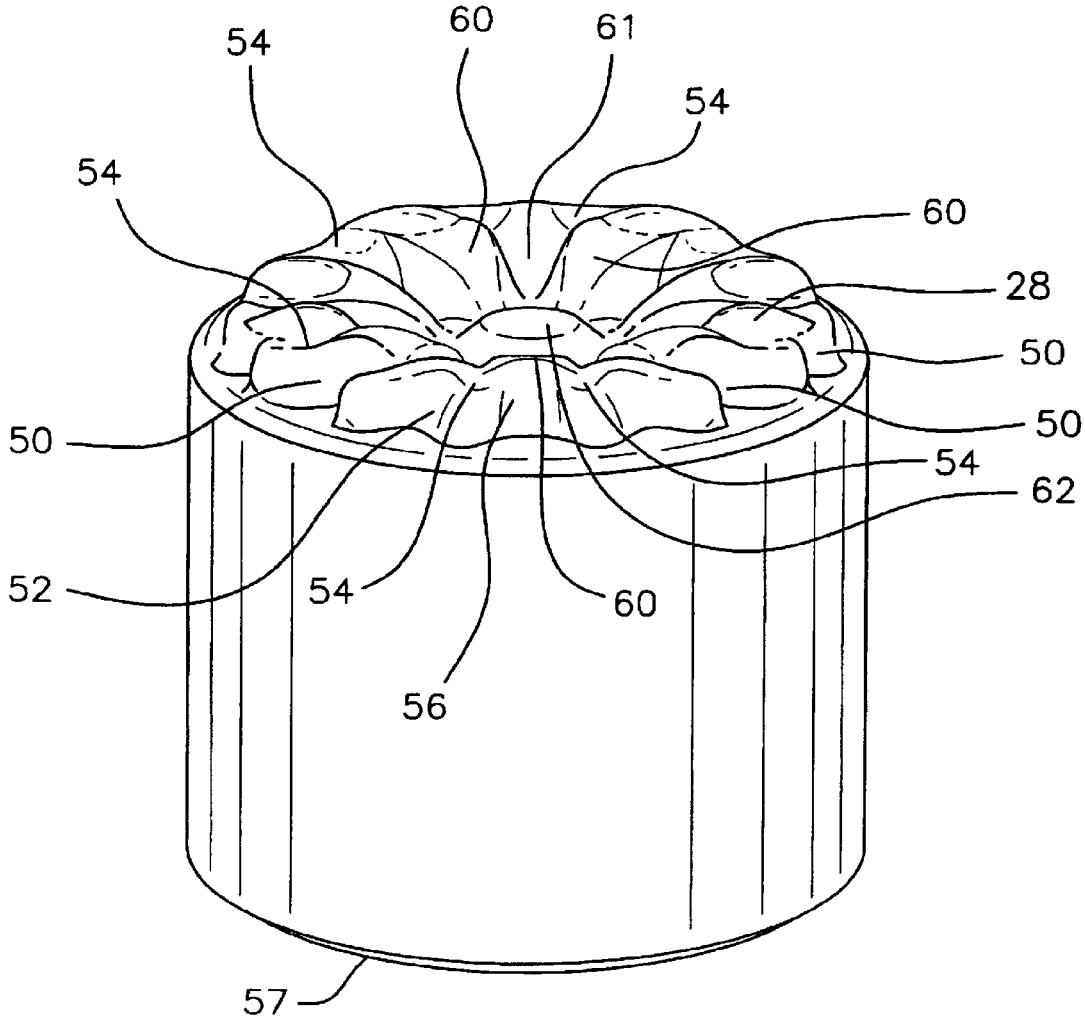
FIG. 13 is a perspective top view of another exemplary embodiment cutting element substrate of the present invention.

In yet a further alternate embodiment shown in FIG. 13, radial depressions 50 are formed on the band 28 extending from an outer surface 52 of the band and extend radially inward. Moreover, top surface or band depressions 54 are formed from a top or bridging surface 56 of the band extending toward a base 57 of the substrate. The bridging surface 56 is a surface portion of the band between an inner surface 61 and the outer surface 52 of the band. In the exemplary embodiment shown in FIG. 13, the radially inwardly extending depressions 50 are staggered from band depressions 54. Ribs 60 extend inward from the band. Moreover, in the exemplary embodiment shown in FIG. 13, each rib 60 extends radially from two consecutive band depressions 54. In an alternate exemplary embodiment, each rib 60 extends radially from a band depression 54. In a further alternate exemplary embodiment, each rib extends radially from a band depression 54 and extends beyond opposite sides of such band depression 54.

In an alternate embodiment, outwardly extending depressions may also be formed from the inner surface 61 of the band opposite the outer surface 52. These outwardly extending depressions maybe staggered relative to the inwardly extending depressions and may be provided instead of the band depressions. A protrusion 62 may also be incorporated at the center of the end surface of the substrate as for example shown in the exemplary embodiment depicted in FIG. 13. As shown in the exemplary embodiment depicted in FIG. 13, the ribs 60 do not extend to the protrusion 62. However, in an alternate embodiment, the ribs may extend to the protrusion 62. Moreover, in the exemplary embodiment shown in FIG. 13, the protrusion 62 tapers from a larger diameter to a smaller diameter as it extends axially in a direction away from the end surface of the substrate. Furthermore with any of the aforementioned exemplary embodiments, the ribs may have a constant thickness, a tapering thickness or a variable thickness.

The depressions incorporated on the band of any of the aforementioned exemplary embodiments may be equidistantly spaced apart, as for example shown in FIG. 13. Moreover, the ribs incorporated in any of the exemplary embodiments may be equidistantly spaced apart as for example shown in FIGS. 11 and 12.

A transition layer may be incorporated between any of the aforementioned exemplary embodiment cutting element substrates and their corresponding ultra hard material layers. The transition layer typically has properties intermediate between those of the substrate and the ultra hard material layer. When a transition layer is used, the transition layer may be draped over the end surface such that it follows the contours of the end surface geometry so that a similar contour is defined on the surface of the transition layer interfacing with the ultra hard material layer. In an alternate embodiment, the transition layer may have a flat or non-planar surface interfacing with the ultra hard material layer. In yet a further alternate embodiment, instead of the interface surface geometry described herein being formed on the substrate, the interface surface geometry is formed on a surface of a transition layer which interfaces with the ultra hard material layer. It should be noted that any transition layer may be a substrate itself. As such, a substrate may be a transition layer for another substrate.

By incorporating the band, the radial depressions, the axial depressions, the ribs, and/or the central protrusion, the interface becomes more tolerant to crack growth which typically initiates at the interface between the ultra hard material layer and the substrate. By having the band, depressions, ribs and protrusions, a crack will have to deflect a greater distance by following the contours defined by the band depressions, ribs and protrusions in order to grow.

The substrate of the exemplary embodiment cutting elements including the exemplary end surface features described herein maybe formed in a mold when the substrate is being cemented. For example, in one exemplary embodiment, tungsten carbide powder is provided in a mold with a binder. The powder is then pressed using a press surface having a design which is the complement of the desired interface surface design. The mold with powder and press are then heated casing the binder to infiltrate and cement the tungsten carbide powder into a substrate body having the desired interface surface geometry. In an alternate embodiment, the substrate body maybe formed using known methods and the desired interface surface may be machined on the interface surface using well known methods.

It should be noted that the term "upper" is used herein as a relative term for describing the relative position of an item and not necessarily describing the exact position of such item.

The preceding merely illustrates the principles of the invention. It will thus be appreciated that those skilled in the art will be able to devise various arrangements which, although not explicitly described or shown herein, embody the principles of the invention and are included within its scope and spirit. Furthermore, all examples and conditional language recited herein are principally intended expressly to be only for pedagogical purposes and to aid in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

What is claimed is:

1. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, and a plurality of ribs extending from the band inward away from the periphery, wherein the bands extends to a height level, wherein each rib comprises a surface, and wherein a vertical distance between said surface and said level increases in an inward direction along each rib length; and an ultra hard material layer over the end surface.

2. A cutting element as recited in claim 1 wherein the end surface further comprises a protrusion, the protrusion being spaced from the band and surrounded by the band.

3. A cutting element as recited in claim 2 wherein the ribs extend from the band to the protrusion.

4. A cutting element as recited in claim 3 wherein the ribs comprise an upper surface and wherein the protrusion comprises an upper surface and wherein the upper surfaces of the rib interface with the upper surface of the protrusion.

5. A cutting element as recited in claim 3 wherein the ribs extend radially inward and wherein a depression having a generally trapezoidal shape in plan view is defined between the band, the protrusion and two consecutive ribs.

6. A cutting element as recited in claim 3 further comprising a plurality of band depressions formed on the band bridging surface portion.

7. A cutting element as recited in claim 6 wherein each of said plurality of ribs extends radially from two consecutive band depressions.

8. A cutting element as recited in claim 7 further comprising a plurality of inwardly extending radial depressions formed on the outer surface portion of the band.

9. A cutting element as recited in claim 8 wherein the plurality of inwardly extending radial depressions are staggered from the plurality of band depressions.

10. A cutting element as recited in claim 6 further comprising a plurality of inwardly extending radial depressions formed on the outer surface portion of the band.

11. A cutting element as recited in claim 2 wherein at least one of said plurality of ribs extends to a location spaced apart from the protrusion.

12. A cutting element as recited in claim 2 wherein said plurality of ribs do not extend to the protrusion.

13. A cutting element as recited in claim 12 further comprising a plurality of band depressions formed on the band bridging surface portion.

14. A cutting element as recited in claim 13 wherein each of said plurality of ribs extends radially from two consecutive band depressions.

15. A cutting element as recited in claim 14 further comprising a plurality of inwardly extending radial depressions formed on the outer surface portion of the band.

16. A cutting element as recited in claim 15 wherein the plurality of inwardly extending radial depressions are staggered from the plurality of band depressions.

17. A cutting element as recited in claim 12 further comprising a plurality of inwardly extending radial depressions formed on the outer surface portion of the band.

18. A cutting element as recited in claim 1 further comprising a plurality of band depressions formed on the band bridging surface portion.

19. A cutting element as recited in claim 18 wherein each of said plurality of ribs extends radially from two consecutive band depressions.

20. A cutting element as recited in claim 19 further comprising a plurality of inwardly extending radial depressions formed on the outer surface portion of the band.

21. A cutting element as recited in claim 20 further comprising a plurality of outwardly extending radial depressions formed on the inner surface portion of the band.

22. A cutting element as recited in claim 20 wherein the plurality of inwardly extending radial depressions are staggered from the plurality of band depressions.

23. A cutting element as recited in claim 1 further comprising a plurality of inwardly extending radial depressions formed on the outer surface portion of the band.

24. A cutting element as recited in claim 1 wherein the end surface perimeter comprises a diameter and wherein the band comprises a radial thickness wherein a maximum radial thickness of the band is in the range of about 2% of the diameter to about 40% of the diameter.

25. A cutting element as recited in claim 1 wherein the ultra hard material layer comprises a thickness as measured at a periphery of said ultra hard material layer, wherein the ultra hard material thickness is not less than about 0.04 inch.

26. A cutting element as recited in claim 1 wherein the ultra hard material layer comprises a thickness as measured at a periphery of said ultra hard material layer, wherein the ultra hard material thickness is greater than about 0.25 inch.

27. A cutting element as recited in claim 1 wherein the ultra hard material layer comprises a thickness as measured at a periphery of said ultra hard material layer, wherein the band comprises an apex, wherein the end surface periphery comprises a diameter and wherein the radial distance from the end surface periphery to the apex is in the range of about 15% of the thickness of the ultra hard material layer to about 35% of the diameter.

28. A cutting element as recited in claim 1 wherein the ultra hard material layer comprises a thickness as measured at a periphery of said ultra hard material layer and wherein the band comprises a height as measured from the periphery of the end surface, wherein the band height is in the range of about 25% to about 85% of the thickness of the ultra hard material layer.

29. A cutting element as recited in claim 28 wherein the band comprises an apex, wherein the periphery comprises a diameter and wherein the radial distance from the periphery of the end surface to the apex is in the range of about 15% of the thickness of the ultra hard material layer to about 35% of the diameter.

30. A cutting element as recited in claim 29 wherein the ultra hard material layer comprises a thickness as measured at a periphery of said ultra hard material layer, wherein the ultra hard material thickness is greater than about 0.25 inch.

31. A cutting element as recited in claim 29 wherein the ultra hard material layer comprises a thickness as measured at a periphery of said ultra hard material layer, wherein the ultra hard material thickness is not less than about 0.04 inch.

32. A cutting element as recited in claim 31 wherein the end surface perimeter comprises a diameter and wherein the band comprises a radial thickness wherein a maximum radial thickness of the band is in the range of about 2% of the diameter to about 40% of the diameter.

33. A cutting element as recited in claim 1 further comprising at least one transition layer between the end surface and the ultra hard material layer.

34. A cutting element as recited in claim 1 wherein the ribs are equidistantly spaced apart.

35. A cutting element comprising:

a substrate comprising an end surface, the end surface comprising, a periphery, and a projecting band spaced from the periphery, the band having a continuous surface defining an inner surface portion closer to a center of the end surface, an outer surface portion closer to the periphery and a bridging surface portion between the inner and outer surface portions, wherein a plurality of band depressions are formed on the band bridging surface portion, wherein the bridging surface portion extends to a height level as measured from the end surface and wherein the inner and outer surface portions extends to height levels as measured from the end surface lower than the height level of the bridging portion, and wherein a plurality of inwardly extending radial depressions are formed on the outer surface portion of the band; and an ultra hard material layer over the end surface.

36. A cutting element as recited in claim 35 wherein the band depressions are staggered from the inwardly extending radial depressions.

37. A cutting element as recited in claim 35 further comprising a plurality of outwardly extending radial depressions formed on the inner surface portion of the band.

38. A cutting element as recited in claim 35 wherein the end surface perimeter comprises a diameter and wherein the band comprises a radial thickness wherein a maximum radial thickness of the band is in the range of about 2% of the diameter to about 40% of the diameter.

39. A cutting element as recited in claim 35 wherein the ultra hard material layer comprises a thickness as measured at a periphery of said ultra hard material layer, wherein the ultra hard material thickness is not less than about 0.04 inch.

40. A cutting element as recited in claim 35 wherein the ultra hard material layer comprises a thickness as measured at a periphery of said ultra hard material layer, wherein the ultra hard material thickness is greater than about 0.25 inch.

41. A cutting element as recited in claim 35 wherein the ultra hard material layer comprises a thickness as measured at a periphery of said ultra hard material layer, wherein the band comprises an apex, wherein the end surface periphery comprises a diameter and wherein the radial distance from the end surface periphery to the apex is in the range of about 15% of the thickness of the ultra hard material layer to about 35% of the diameter.

42. A cutting element as recited in claim 35 wherein the ultra hard material layer comprises a thickness as measured at a periphery of said ultra hard material layer and wherein the band comprises a height as measured from the periphery of the end surface, wherein the band height is in the range of about 25% to about 85% of the thickness of the ultra hard material layer.

43. A cutting element as recited in claim 42 wherein the band comprises an apex, wherein the periphery comprises a diameter and wherein the radial distance from the periphery of the end surface to the apex is in the range of about 15% of the thickness of the ultra hard material layer to about 35% of the diameter.

44. A cutting element as recited in claim 43 wherein the ultra hard material layer comprises a thickness as measured at a periphery of said ultra hard material layer, wherein the ultra hard material thickness is greater than about 0.25 inch.

45. A cutting element as recited in claim 43 wherein the ultra hard material layer comprises a thickness as measured at a periphery of said ultra hard material layer, wherein the ultra hard material thickness is not less than about 0.04 inch.

46. A cutting element as recited in claim 45 wherein the end surface perimeter comprises a diameter and wherein the band comprises a radial thickness wherein a maximum radial thickness of the band is in the range of about 2% of the diameter to about 40% of the diameter.

47. A cutting element as recited in claim 46 wherein the band depressions are staggered from the inwardly extending radial depressions.

48. A cutting element as recited in claim 35 wherein the end surface further comprises a protrusion, the protrusion being spaced from the band and surrounded by the band.

49. A cutting element as recited in claim 35 further comprising at least one transition layer between the end surface and the ultra hard material layer.

50. A cutting element as recited in claim 35 wherein the plurality of band depressions are equidistantly spaced apart along the band and wherein the plurality of inwardly extending radial depressions are equidistantly spaced apart along the band.

51. A bit comprising:

a body; and a plurality of cutting elements mounted on the bit body, each cutting element comprising, a substrate comprising an end surface, the end surface comprising, a periphery a projecting band spaced from the periphery, the band having a continuous surface defining an inner surface portion closer to a center of the end surface, an outer surface portion closer to the periphery and a bridging surface portion bridging the inner and outer surface portions, and a plurality of ribs extending from the band inward away from the periphery, wherein the band extends to a height level, wherein each rib comprises a surface, and wherein a vertical distance between said surface and said level increases in an inward direction along each rib length; and an ultra hard material layer over the end surface.

52. A bit comprising:

a body; and a plurality of cutting elements mounted on the bit body, each cutting element comprising, a substrate comprising an end surface, the end surface comprising, a periphery, and a projecting band spaced from the periphery, the band having a continuous surface defining an inner surface portion closer to a center of the end surface, an outer surface portion closer to the periphery and a bridging surface portion between the inner and outer surface portions, wherein a plurality of band depressions are formed on the band bridging surface portion, wherein the bridging surface portion extends to a height level as measured from the end surface and wherein the inner and outer surface portions extend to height levels as measured from the end surface lower than the height level of the bridging portion, and wherein a plurality of inwardly extending radial depressions are formed on the outer surface portion of the band, and an ultra hard material layer over the end surface.

53. A cutting element as recited in claim 1 wherein the thickness of each rib decreases along said inward direction.

54. A cutting element as recited in claim 53 wherein a height of each rib decreases along said inward direction.

55. A cutting element as recited in claim 1 wherein a height of each rib decreases along said inward direction.

56. A cutting element as recited in claim 1 wherein the each of the inner, outer and bridging surface portions of the band are curved in cross-section viewed along a plane through a central axis of the cutting element substrate.

57. A cutting element as recited in claim 35 wherein the each of the inner, outer and bridging surface portions of the band are curved in cross-section viewed along a plane through a central axis of the cutting element substrate.

58. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, a plurality of band depressions formed on the band bridging surface portion, a protrusion spaced from the band and surrounded by the band, and a plurality of ribs extending from the band inward away from the periphery and to the protrusion, wherein each of said plurality of ribs extends radially from two consecutive band depressions; and an ultra hard material layer over the end surface.

59. A cutting element as recited in claim 58 further comprising a plurality of inwardly extending radial depressions formed on the outer surface portion of the band.

60. A cutting element as recited in claim 59 wherein the plurality of inwardly extending radial depressions are staggered from the plurality of band depressions.

61. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, a plurality of band depressions formed on the band bridging surface portion, a protrusion spaced from the band and surrounded by the band, and a plurality of ribs extending from the band inward away from the periphery, wherein said plurality of ribs do not extend to the protrusion, and wherein each of said plurality of ribs extends radially from two consecutive band depressions; and an ultra hard material layer over the end surface.

62. A cutting element as recited in claim 61 further comprising a plurality of inwardly extending radial depressions formed on the outer surface portion of the band.

63. A cutting element as recited in claim 62 wherein the plurality of inwardly extending radial depressions are staggered from the plurality of band depressions.

64. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, a plurality of band depressions formed on the band bridging surface portion, and a plurality of ribs extending from the band inward away from the periphery, wherein each of said plurality of ribs extends radially from two consecutive band depressions; and an ultra hard material layer over the end surface.

65. A cutting element as recited in claim 64 further comprising a plurality of inwardly extending radial depressions formed on the outer surface portion of the band.

66. A cutting element as recited in claim 65 further comprising a plurality of outwardly extending radial depressions formed on the inner surface portion of the band.

67. A cutting element as recited in claim 65 wherein the plurality of inwardly extending radial depressions are staggered from the plurality of band depressions.

68. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, and a plurality of ribs extending from the band inward away from the periphery; and an ultra hard material layer over the end surface, wherein the ultra hard material layer comprises a thickness as measured at a periphery of said ultra hard material layer, wherein the band comprises an apex, wherein the end surface periphery comprises a diameter and wherein the radial distance from the end surface periphery to the apex is in the range of about 15% of the thickness of the ultra hard material layer to about 35% of the diameter.

69. A cutting element comprising:

a substrate comprising an end surface, the end surface comprising, a periphery, a projecting band spaced from the periphery, the band having a continuous surface defining an inner surface portion closer to a center of the end surface, an outer surface portion closer to the periphery and a bridging surface portion bridging the inner and outer surface portions, and a plurality of ribs extending from the band inward away from the periphery; and an ultra hard material layer over the end surface, wherein the ultra hard material layer comprises a thickness as measured at a periphery of said ultra hard material layer, wherein the band comprises a height as measured from the periphery of the end surface, wherein the band height is in the range of about 25% to about 85% of the thickness of the ultra hard material layer, wherein the band comprises an apex, wherein the periphery of the end surface comprises a diameter and wherein the radial distance from the periphery of the end surface to the apex is in the range of about 15% of the thickness of the ultra hard material layer to about 35% of the diameter.

70. A cutting element as recited in claim 69 wherein the ultra hard material layer comprises a thickness as measured at the periphery of said ultra hard material layer, wherein the ultra hard material thickness is greater than about 0.25 inch.

71. A cutting element as recited in claim 69 wherein the ultra hard material layer comprises a thickness as measured at the periphery of said ultra hard material layer, wherein the ultra hard material thickness is not less than about 0.04 inch.

72. A cutting element as recited in claim 71 wherein the end surface perimeter comprises a diameter and wherein the band comprises a radial thickness wherein a maximum radial thickness of the band is in the range of about 2% of the diameter to about 40% of the diameter.

73. A cutting element comprising:

a substrate comprising an end surface, the end surface comprising, a periphery, and a projecting band spaced from the periphery, the band having a continuous surface defining an inner surface portion closer to a center of the end surface, an outer surface portion closer to the periphery and a bridging surface portion between the inner and outer surface portions, wherein a plurality of band depressions are formed on the band bridging surface portion, wherein a plurality of inwardly extending radial depressions are formed on the outer surface portion of the band, and wherein the band depressions are staggered from the inwardly extending radial depressions; and an ultra hard material layer over the end surface.

74. A cutting element comprising:

a substrate comprising an end surface, the end surface comprising, a periphery, and a projecting band spaced from the periphery, the band having a continuous surface defining an inner surface portion closer to a center of the end surface, an outer surface portion closer to the periphery and a bridging surface portion between the inner and outer surface portions, wherein a plurality of band depressions are formed on the band bridging surface portion, and wherein a plurality of inwardly extending radial depressions are formed on the outer surface portion of the band; and an ultra hard material layer over the end surface, wherein the ultra hard material layer comprises a thickness as measured at a periphery of said ultra hard material layer, wherein the band comprises an apex, wherein the end surface periphery comprises a diameter and wherein the radial distance from the end surface periphery to the apex is in the range of about 15% of the thickness of the ultra hard material layer to about 35% of the diameter.

75. A cutting element comprising:

a substrate comprising an end surface, the end surface comprising, a periphery, and a projecting band spaced from the periphery, the band having a continuous surface defining an inner surface portion closer to a center of the end surface, an outer surface portion closer to the periphery and a bridging surface portion between the inner and outer surface portions, wherein a plurality of band depressions are formed on the band bridging surface portion, and wherein a plurality of inwardly extending radial depressions are formed on the outer surface portion of the band; and an ultra hard material layer over the end surface, wherein the ultra hard material layer comprises a thickness as measured at a periphery of said ultra hard material layer and wherein the band comprises a height as measured from the periphery of the end surface, wherein the band height is in the range of about 25% to about 85% of the thickness of the ultra hard material layer, and wherein the band comprises an apex, wherein the periphery of the end surface comprises a diameter and wherein the radial distance from the periphery of the end surface to the apex is in the range of about 15% of the thickness of the ultra hard material layer to about 35% of the diameter.

76. A cutting element as recited in claim 75 wherein the ultra hard material layer comprises a thickness as measured at the periphery of said ultra hard material layer, wherein the ultra hard material thickness is greater than about 0.25 inch.

77. A cutting element as recited in claim 75 wherein the ultra hard material layer comprises a thickness as measured at the periphery of said ultra hard material layer, wherein the ultra hard material thickness is not less than about 0.04 inch.

78. A cutting element as recited in claim 77 wherein the end surface perimeter comprises a diameter and wherein the band comprises a radial thickness wherein a maximum radial thickness of the band is in the range of about 2% of the diameter to about 40% of the diameter.

79. A cutting element as recited in claim 78 wherein the band depressions are staggered from the inwardly extending radial depressions.

* * * * *

UNITED STATES PATENT AND TRADEMARK OFFICE

CERTIFICATE OF CORRECTION

PATENT NO. : 6,962,218 B2
DATED : November 8, 2005
INVENTOR(S) : Eyre

It is certified that error appears in the above-identified patent and that said Letters Patent is hereby corrected as shown below:

Column 2,
Line 67, after “layer”, insert -- is formed --.

Column 4,
Line 22, after “such”, insert -- as --.

Column 5,
Line 30, delete “fraustum-conical”, insert -- frustum-conical --.

Column 6,
Line 29, delete “maybe”, insert -- may be --.

Column 7,
Line 19, delete “casing”, insert -- causing --.
Line 22, delete “maybe” insert -- may be --.
Line 64, delete “bands”, insert -- band --.

Column 9,
Line 66, delete “extends”, insert -- extend --.

Signed and Sealed this

Thirtieth Day of May, 2006

JON W. DUDAS
*Director of the United States Patent and Trademark Office*